US009452523B2

(12) United States Patent
Hokanson

(10) Patent No.: US 9,452,523 B2
(45) Date of Patent: Sep. 27, 2016

(54) ADJUSTABLE AUGER RACK WITH FLIGHTING SECUREMENT FACILITATING VERTICAL USE, STORAGE AND/OR TRANSPORT OF AUGER OR DRILL BIT(S)

(71) Applicant: Craig Richard Hokanson, Clearfield, UT (US)

(72) Inventor: Craig Richard Hokanson, Clearfield, UT (US)

( * ) Notice: Subject to any disclaimer, the term of this patent is extended or adjusted under 35 U.S.C. 154(b) by 405 days.

(21) Appl. No.: 14/164,060

(22) Filed: Jan. 24, 2014

(65) Prior Publication Data

US 2015/0209955 A1 Jul. 30, 2015

(51) Int. Cl.

| | |
|---|---|
| ***B25H 3/00*** | (2006.01) |
| ***B25H 3/04*** | (2006.01) |
| ***E21B 19/14*** | (2006.01) |

(52) U.S. Cl.

CPC ..... *B25H 3/003* (2013.01); *B25H 3/04* (2013.01); *E21B 19/14* (2013.01)

(58) Field of Classification Search

CPC ..... B25H 3/003; B25H 3/04; E21B 19/14

USPC ..... 211/13.1

See application file for complete search history.

(56) References Cited

U.S. PATENT DOCUMENTS

| | | | | |
|---|---|---|---|---|
| 2010/0307827 | A1* | 12/2010 | Piipponen | 175/52 |
| 2012/0234780 | A1* | 9/2012 | Hokanson | 211/69 |
| 2013/0213913 | A1* | 8/2013 | Kohlgruber | 211/85.8 |
| 2013/0220949 | A1* | 8/2013 | Sargent | 211/4 |
| 2015/0209954 | A1* | 7/2015 | Hokanson | |

FOREIGN PATENT DOCUMENTS

| | | | | |
|---|---|---|---|---|
| DE | 3400069 | A1 * | 7/1985 | A47F 7/19 |

* cited by examiner

*Primary Examiner* — Jerry Redman
(74) *Attorney, Agent, or Firm* — Steven Rinehart

(57) ABSTRACT

A rack is disclosed, adapted to facilitate efficient transport, use and storage of augers, including foundation augers. The rack comprises a frame and a plurality of upwardly rising tower assemblies which grip or lock the helical flighting on earth augers. In various embodiments, components of the rack are adjustable to accommodate differing diameters of the auger, differing angles of incline of flighting, and differing heights of augers and their flighting.

14 Claims, 7 Drawing Sheets

ADJUSTABLE AUGER RACK WITH FLIGHTING SECUREMENT FACILITATING VERTICAL USE, STORAGE AND/OR TRANSPORT OF AUGER OR DRILL BIT(S)

CROSS-REFERENCE TO OTHER APPLICATIONS

This patent application claims priority to, and incorporates, U.S. provisional patent application Ser. No. 14/795,782 entitled "Auger Rack with Flighting Securement Facilitating Vertical Use, Storage and Transport of Auger or Drill Bits" filed on Jan. 25, 2013 for Craig Richard Hokanson.

BACKGROUND OF THE INVENTION

1. Field of the Invention

This invention relates to construction implements, and more particularly relates to an implement for transportation, use and storage of heavy augers.

2. Description of the Related Art

Foundation augers, utility auger and general purpose augers are well-known in the art, and often used in constructing deep foundations for industrial or commercial buildings. Foundation augers, like all earth augers, comprise helical flighting used in drilling to extract earth and aggregate from a ground surface in a construction area. In the case of foundation auger, the dimension of the auger are much greater than with other augers used to drill wells or for other application. Foundation augers can weigh thousands, or even tens of thousands, of pounds. Foundation augers can be difficult or impossible to oriten upright once they have fallen out of the upright position.

Because foundation augers vary in size, shape, weight and the incline angle of their flighting, simple universal rack for storing foundation augers do not exist in the art, much less a universal rack able to store foundation augers of a wide variety of sizes and shapes.

Foundation augers must be detachably affixed to a large drive motor, which suspends them, which drive motor is usually connected to a mechanized vehicle, drilling stations, and/or other machine known to those of skill in the art, including a skid steer, backhoe, excavator, mini excavator, compact track loader, Bobcat®, truck-mounted Derrick digger, pressure digger, or any of a plethora of various types of tractors and track vehicles.

Because of their size, foundation auger are particularly difficult to safely transport and store, and there exists no efficient means in the art of storing or securing foundation augers in an upright position so they can be handled, managed and moved vertically.

There is a need in the art for safer and more efficient apparati and method of securing large foundation augers. It is therefore desirable that an auger rack be provided which facilitates ease of vertical auger transport, storage, use and interchange.

SUMMARY OF THE INVENTION

From the foregoing discussion, it should be apparent that a need exists for an auger rack for vertical auger transport, storage, use and interchange. Beneficially, such an apparatus would overcome many of the difficulties with prior art by providing a safer means for securing, transporting, storing, using and interchanging a plurality of augers by a single operator.

The present invention has been developed in response to the present state of the art, and in particular, in response to the safety problems and needs in the art that have not yet been fully solved by currently available aparati. Accordingly, the present invention has been developed to provide a rack for vertically securing a foundation auger, the rack comprising: a frame comprising: two or more track frames between 0.1 meters and 10 meters in length, the track frames comprising elongated structural components formed from a rigid metallic substance, each track frame defining a track through which an adjustable tower assembly travels; wherein each track frame is oriented to converge diagonally across an x axis and across a y axis toward a common center point of the rack; two or more upwardly rising adjustable tower assemblies, each assembly slidably affixed to a track frame, each adjustable tower assembly comprising: an inner tube; an outer tube, wherein the inner tube slides within the outer tube along a z axis telescopically such that a height of the tower assembly is adjustable; a flighting rest affixed to one of the inner tube and outer tube, the flighting rest for supporting a lower surface of helical flighting on an auger; a locking mechanism for locking the helical flighting of the auger in place; wherein each adjustable tower assembly slides along a track frame.

In some embodiments, the common center point of the rack is defined by a recess separating the track frames, the recess for securing a tip of an auger from lateral movement. In other embodiments, the rack further comprise one or more fork pockets. The rack may further comprise one or more feet for engaging a ground surface.

The rack may further comprise a sub frame affixed beneath the track frames on the z axis. The rack may further comprise a plurality of tie down points. Each tower assembly may comprise a baseplate slidably affixed to a track frame such that the tower assemblies may be adjusted inward or outward to accommodate augers of different diameters.

Each tower assembly may further comprise a cantilevered locking lever hingedly affixed to the tower assembly such that the locking lever secures a top surface of helical flighting of an auger. The flighting rest may be hingedly affixed to the tower assembly such that the flighting rest may be angled to correlate to the incline of helical flighting of an auger.

The rack, in some embodiments, further comprises a detachable lifting adapter, the detachable lifting adapter for facilitating craning of the rack and auger, the lifting adapter comprising: an inner sleeve for insertable engagement of an auger shaft, the inner sleeve defining an aperture for receiving a pin traversing the inner sleeve and a corresponding aperture in the auger shaft, the pin interlocking the lifting adapter and auger shaft; and a lifting eye affixed to the inner sleeve for hoisting the auger and rack overhead.

The rack may further comprise one or more crossmembers for increased stability of the rack. The track frame may be oriented in one of x-shaped fashion and y-shaped fashion.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to convey a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
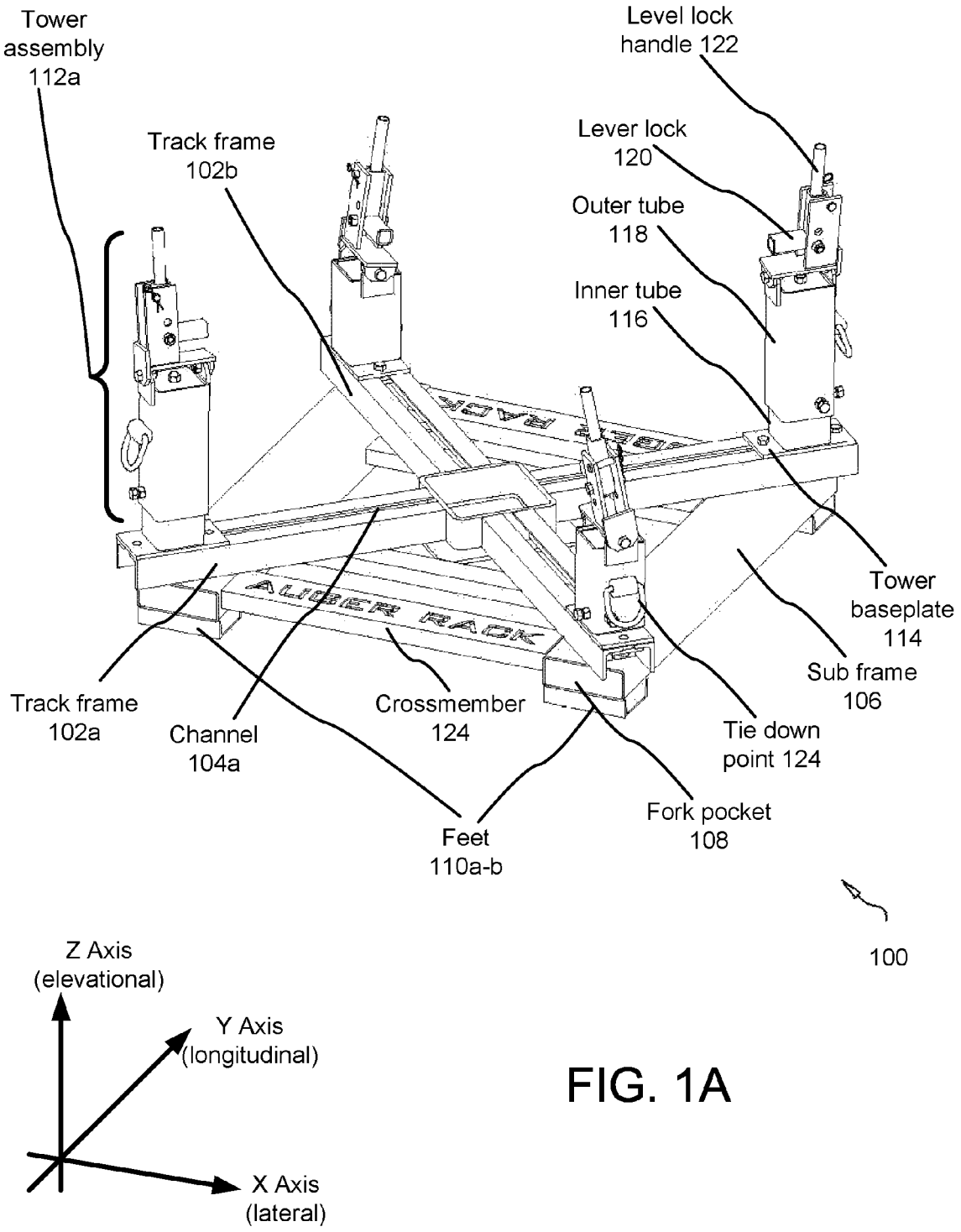
FIG. 1A is a side elevational perspective view of an adjustable pressure digger rack in accordance with the present invention.

FIG. 1A is a side elevational perspective view of an adjustable pressure digger rack 100 in accordance with the present invention. The rack 100 comprises a track frame 102, a track frame 102*b*, a channel 104*a*, a sub frame 106, a fork pocket 108, feet 110*a-b*, a tower assembly 112, a tower baseplate 114, an inner tube 116, an outer tube 118, a lever lock 120, a lever lock handle 122, and a tie down point 124.

The rack 100 as shown is for use, storage and/or transport of foundation augers, utility augers, or general purpose auger comprising helical flighting. The rack 100 secures the auger at its flighting in an upright position, and the rack 100 is adjustable to accommodate augers of various shapes, sizes, and weights.

The term "auger" as used herein is defined to include earth augers, foundation augers, and drill bits used in industrial or construction applications. Thus, the term "auger rack" defines a rack for suspending an auger in an upright position.

In various other embodiments, the components of the rack 100 are welded, bolted or fastened together. The rack 100 may also be designed as an X-frame as shown in attached drawing/sketch, which X-frame may be fixed or adjustable to accommodate bits of different diameters or widths. The frame may be square, rectangular, circular, ovoid, octagonal, triangular or otherwise shaped.

In the shown embodiment, the track frames 102 emanate outwardly across a plane formed by the x and y axes from a common center point on the rack 100. In the shown embodiment, that common center point is defined by a square bracket defining a hollow recess for receiving the tip of an auger suspended in the rack 100. This square bracket is affixed to each of the track frames 102. This bracket may circular or otherwise shaped. The track frames 102 may define a recess at the common center point. A tip lowered into the recess also serves to lower the center of gravity of the rack 100 and auger.

The tower assemblies 112 extend upwards in orthogonal fashion from the track frames 102 along the z axis, and are further described below. The tower assemblies 112 rising orthogonally from the track frames 102 may be telescopic or otherwise adjustable. The tower assemblies 112 may slide in a channel, track, rail or guide member in the track frame 102, snap in slots or grooves on a track frame 102, or may be bolted or pinned through a track frame 102 via any other adjustable means known to those of skill in the art.

The tower baseplate 114 slidably connects the tower assembly 112 to the track frame 102, and the baseplate 114 may comprise any component that connects or interconnects the tower assembly 112 to a track, channel, or guide member, including a track connector.

The tower assembly comprises a number of components described further below in relation to FIG. 1B, including flighting rests 154 having fixed or an adjustable pitch surfaces of between 0°-65°. In other words, the flighting rests 154 may tilt while affixed to the tower assembly 112. The flighting rests 154 towers may be spring-biased to rest in one upright position.

The flighting rests 154 may be lockable in one tilted position, and may or may not tilt as part of the flighting tower. The flighting rests 154 may comprise any mechanism for affixing, clamping, pinning, fastening or attaching the rack to the flighting.

Clamps on the tower assemblies 112 may be adjustable to clamp down on flighting of differing thicknesses and may also be adjustable to clamp down with adjustable amount of pressure or force.

The tower baseplates 114 may be substantially square, circular, triangular, polygonal, or the like. The baseplates 114 may comprise tread, or texturing, to prevent slippage of the tower assemblies across the track frames 102.

Fork pockets may or may not be incorporated into the rack 100 or sub frame 106 of the rack. Baseplates or feet may or may not be incorporated into the sub frame 106 of the rack.

The rack 100 could be permanently designed into a truck bed itself or into a trailer, perhaps in connection with other racks 100, allowing for multiple augers to be transported with or behind the truck. The rack 100 may be designed to be secured by brackets to the truck or trailer. The rack 100 may be designed with a cup, receptacle, or cylinder member having an open top for receiving a bit inserted into the rack, truck or trailer which is then secured by cross bars disposed over flighting or flighting locks.

Each of the components of the sub frame 106, the tower assembly 112, and the track frames 102, may comprise elongated, hollow steel tube. Each of these components may alternatively comprise rods, beams, I-beams, angle beam, bar stock, H-beams, C-beams (i.e. channel), plates, pipes, or other structural members. The members may define a number of holes, bores, or apertures drilled through the members for securing aftermarket components to the rack 100. Each member may be manufactured from polymers, wood, metals, alloys, and the like. Each member may be curved, bent, or angled along either their y-axis, z-axis, or an orthogonal x-axis.

The rack 100 may comprise numerous lifting points and/or tie down points 124 for allowing for crane rigging to pick the rack 100 and a secured auger directly from a ground surface. The shown embodiment includes inverted U-shaped members, but may comprise I-beams, tubes, pipes, and the like.

The sub frame 106 comprises structural members, such as the crossmember 124, affixed to one another to form a chassis or frame underlaying the track frames 102. In the shown embodiment, the sub frame 106 is square. In other embodiments, the sub frame 106 may be otherwise shaped.

The feet help to keep gravel and dirt out of the fork pockets 108 and sub frame 106.

Figure 1B:
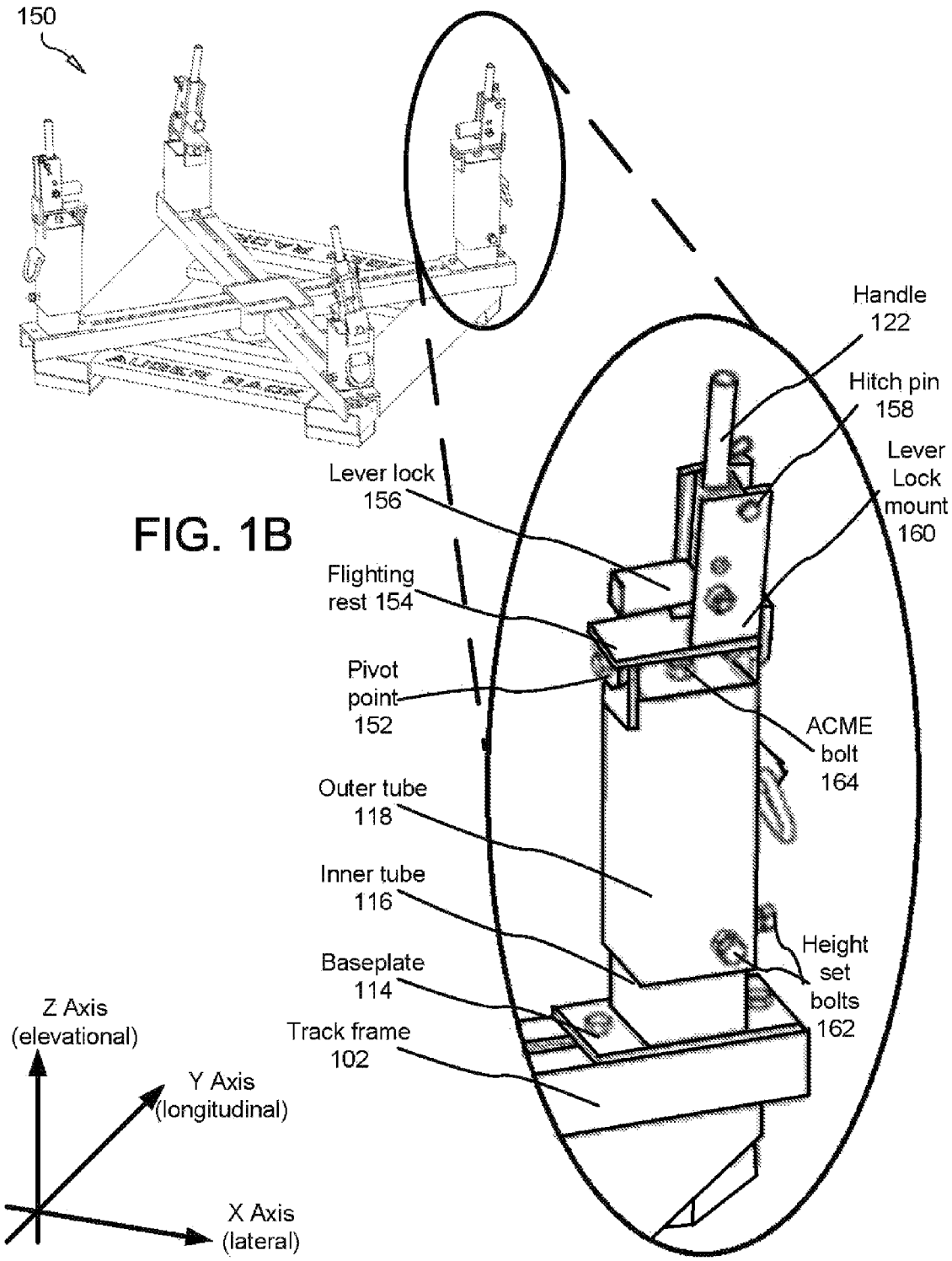
FIG. 1B is a side elevational perspective view of an adjustable pressure digger rack, showing an exploded view of a tower, in accordance with the present invention.

FIG. 1B is a side elevational perspective view of an adjustable pressure digger rack 150, showing an exploded view of a tower, in accordance with the present invention. The tower assembly 112 comprises a baseplate 114, an inner tube 116, an outer tube 118, flighting rest 154 connected at a pivot point 152, a lever lock 156, a handle 122, a hitch pin 158, a lever lock mount 160, an adjustment bolt 164 which maybe be an acme bolt, and height set bolts 162.

The inner tube 116 is affixed to the baseplate 114, and travels within an outer sleeve 118 disposed above the baseplate 114 on the z axis.

The outer tube 118 extends telescopically away from, and upwardly, from the baseplate 114, thus providing means of adjusting the height of the tower assembly 112.

The inner tube 116 and outer tube 118 may comprise tubes, pipes, bar, rods, cylinders, and other elongated components as known to those of skill in the art.

The flighting rest 154 is hingedly connected to the tower assembly 112. In the shown embodiment, the flighting rest 154 is connected at a pivot point 152 on a bracket affixed to the outer sleeve 118 with an adjustment bolt 164. The flighting rest 154 thus tilts to conform to the inched angling of helical flighting on an auger secured by the rack 150.

The flighting rest 154 may affixed pivotably to the outer tube 118 or inner tube 116 or using means known to those of skill in the art, including an adjustment bolt 164. The flighting rest may be joined, coupled, welded in place at a desired angle or pitch, or otherwise affixed using means known to those of art to the outer or inner tube.

Height set bolts 162 are adjustable to clamp the outer tube 118 to the inner tube 116 and fix the height of the tower assembly 112.

A lever lock mount 160 is affixed to the flighting rest 154, which lever lock mount 160 is hingedly affixed to a lever lock 156. The lever lock 156 is rotated from a vertical to a horizontal position by an operator gripping the handle 122. The lever lock 156 is locked over the top surface of helical flighting on an auger, then held in place by a hitch pin 158 inserted through apertures or bore holes in the lever lock mount 160.

Figure 2:
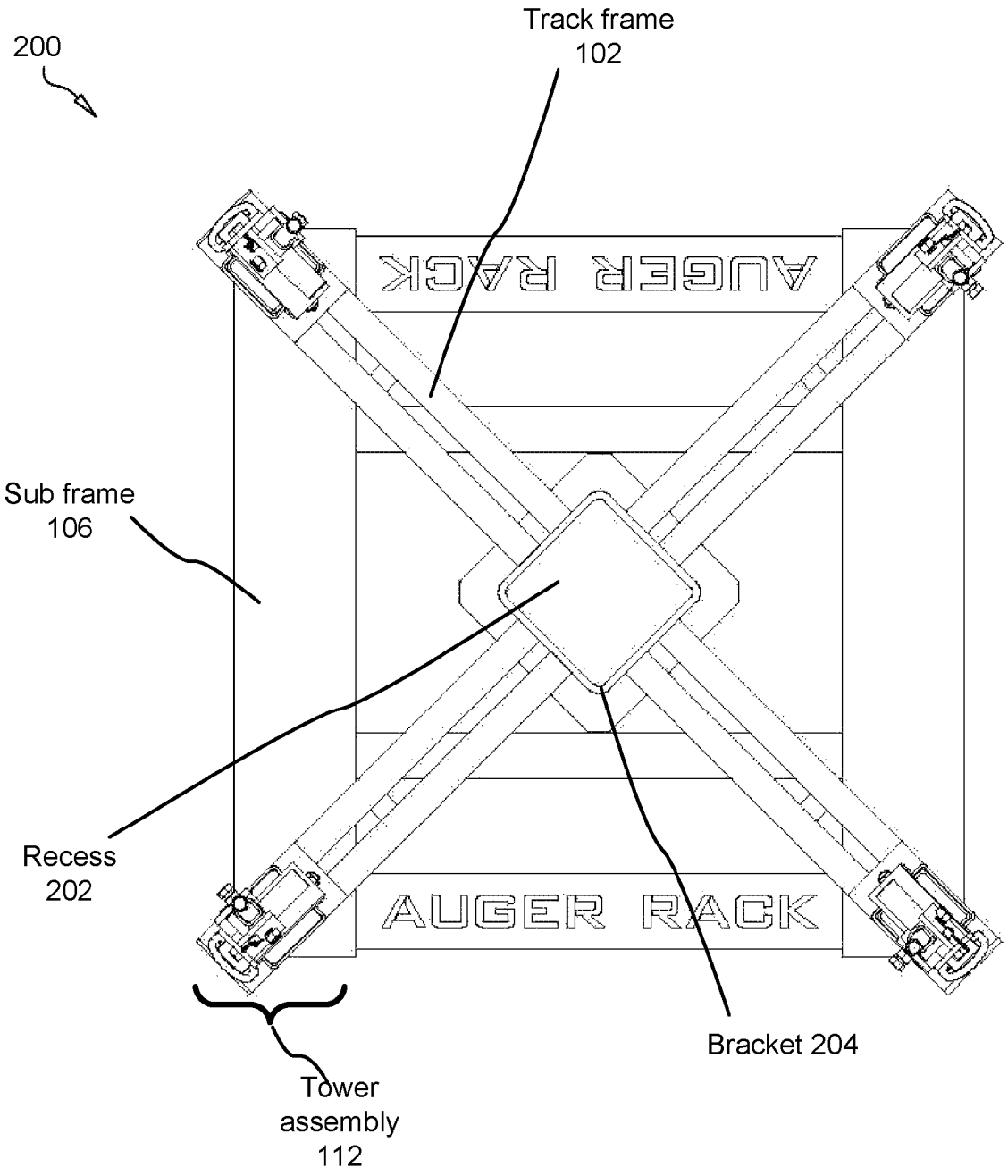
FIG. 2 is an upper perspective view of an adjustable pressure digger rack in accordance with the present invention.

FIG. 2 is an upper perspective view of an adjustable pressure digger rack 200 in accordance with the present invention. The pressure digger rack 200 comprises a track frame 102, a sub frame 106, a tower assembly 112, a recess 202.

The sub frame 106 and tower assembly 112 are described above in relation to FIGS. 1A-1B.

The recess 202 is defined by the bracket 204 interjoining the track frames 102.

The tower assemblies 112 slide along the channel 104 or track defined by the track frames 102. The tower assemblies are adjustable inward or outward to accommodate augers 202 of varying sizes, shapes, weights and dimensions.

Figure 3:
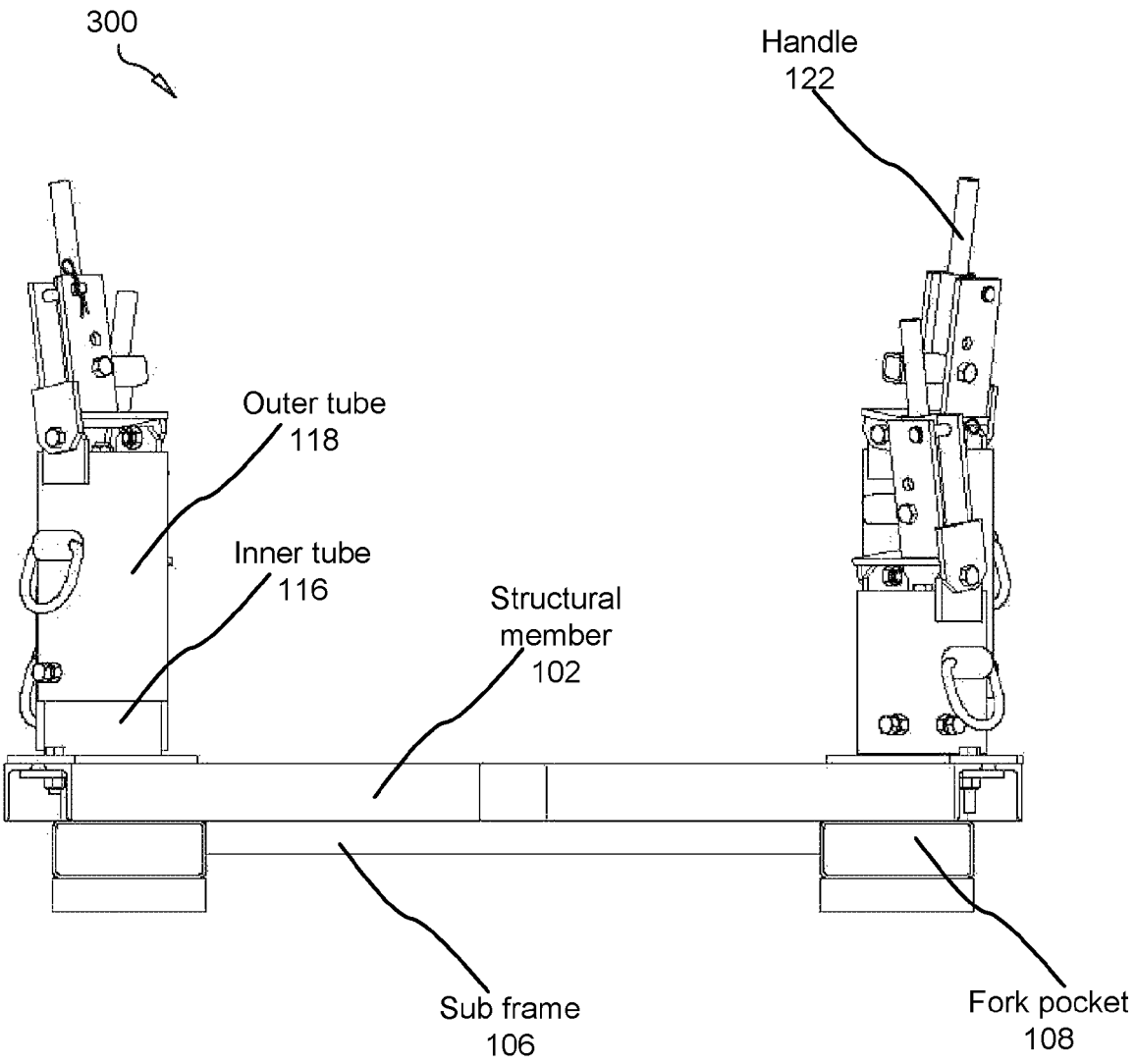
FIG. 3 is a side perspective view of an adjustable pressure digger rack in accordance with the present invention.

FIG. 3 is a side perspective view of an adjustable pressure digger rack 300 in accordance with the present invention. The pressure digger rack 300 comprises a sub frame 106, a fork pocket 108, track frame 102, an inner tube 116, an outer tube 118, and a handle 122.

As shown.

Figure 4:
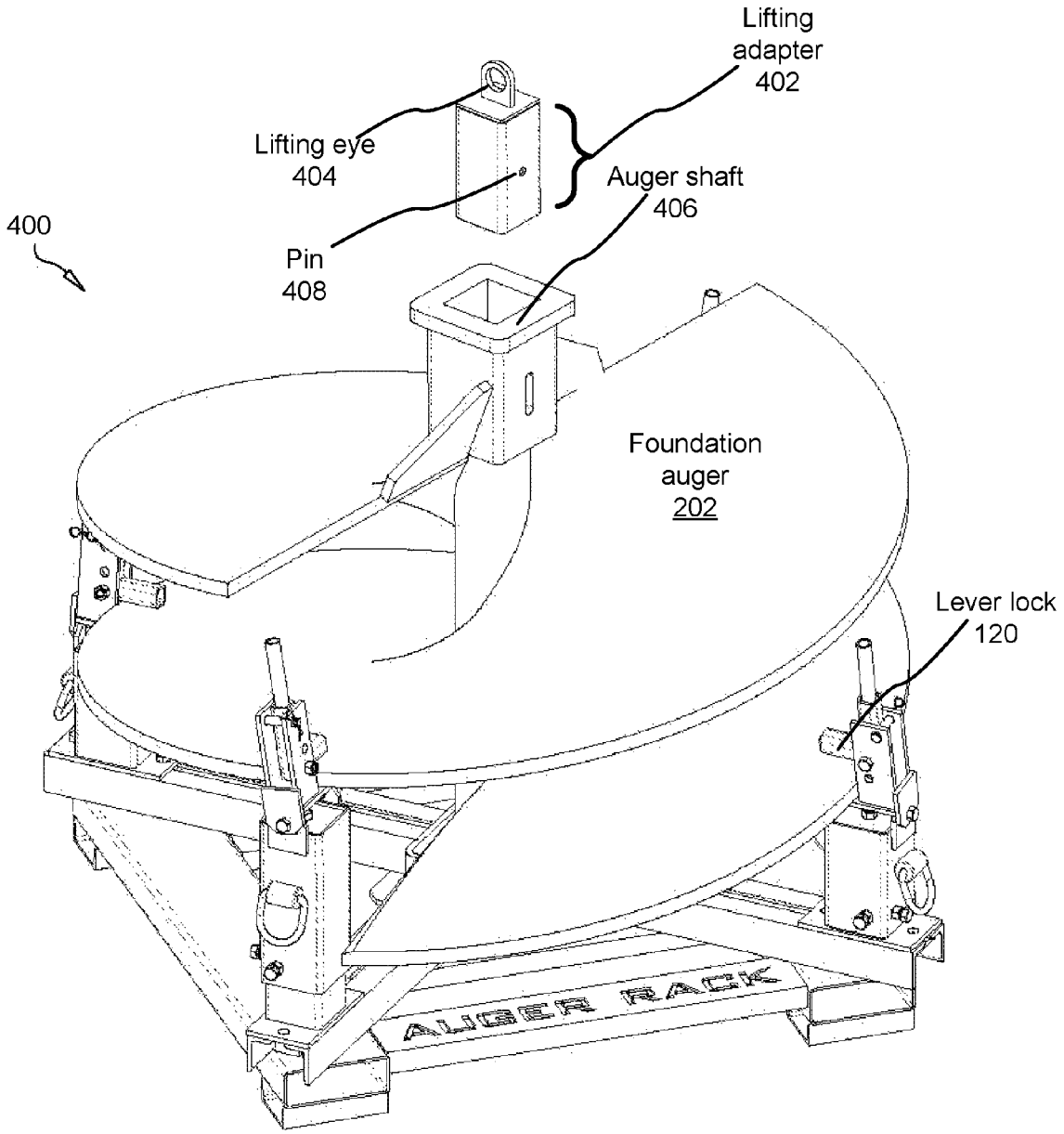
FIG. 4 is a side elevational perspective view of an adjustable pressure digger rack in accordance with the present invention.

FIG. 4 is a side elevational perspective view of an adjustable pressure digger rack in accordance with the present invention. The pressure digger rack 400 comprises a lever lock 120, a foundation auger 202, and a lifting adapter 402 defining a pin hole 408 and lifting eye 404.

The foundation auger 202 is secured to the rack 400 properly in the shown embodiment. The lever lock 120 has been locked down horizontally over the top surface of the flighting of the auger 202.

The lifting adapter 402 exists for facilitating craning or lifting overhead the foundation auger 202 and rack 400. The lifting adapter 402 is detachable from the auger 202. The lifting adapter 402 is insertable into the auger shaft 406 of the auger 202, and connectable to the auger shaft 406 with a pin through the pin hole 408.

The shaft 406 of auger 202 defines a recess commonly used to connect the auger 202 to a drive motor. The lifting adapter 402 comprises a pin hole 408 into which a pin is insertable. The pin hole 408 may comprise a recess, bore, aperture, or groove in the auger 202 shaft usually used for connecting the auger 202 to the drive motor. The pin which traverses the pin hole 408 also traverses the auger shaft 406.

Figure 5:
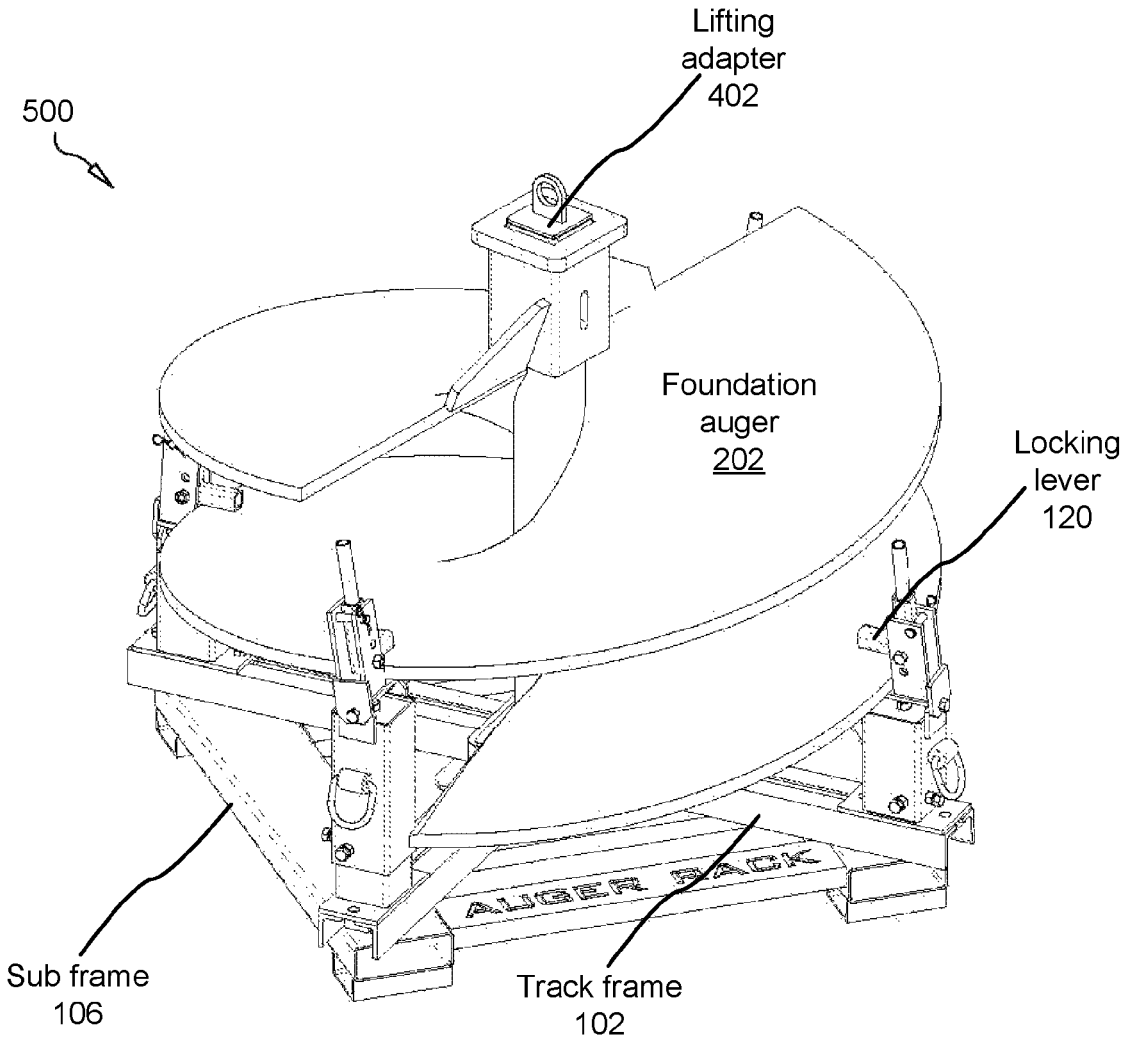
FIG. 5 is a side elevational perspective view of an adjustable pressure digger rack in accordance with the present invention.

FIG. 5 is a side elevational perspective view of an adjustable pressure digger rack in accordance with the present invention. The pressure digger rack 500 comprises a sub frame 106, track frame 102, a locking lever 120, a foundation auger 202, and lifting adapter 402.

FIG. 5 shows an auger 202 in secured position in the rack 500 with a lifting adapter 402 insertably connected to the auger 202.

Figure 6:
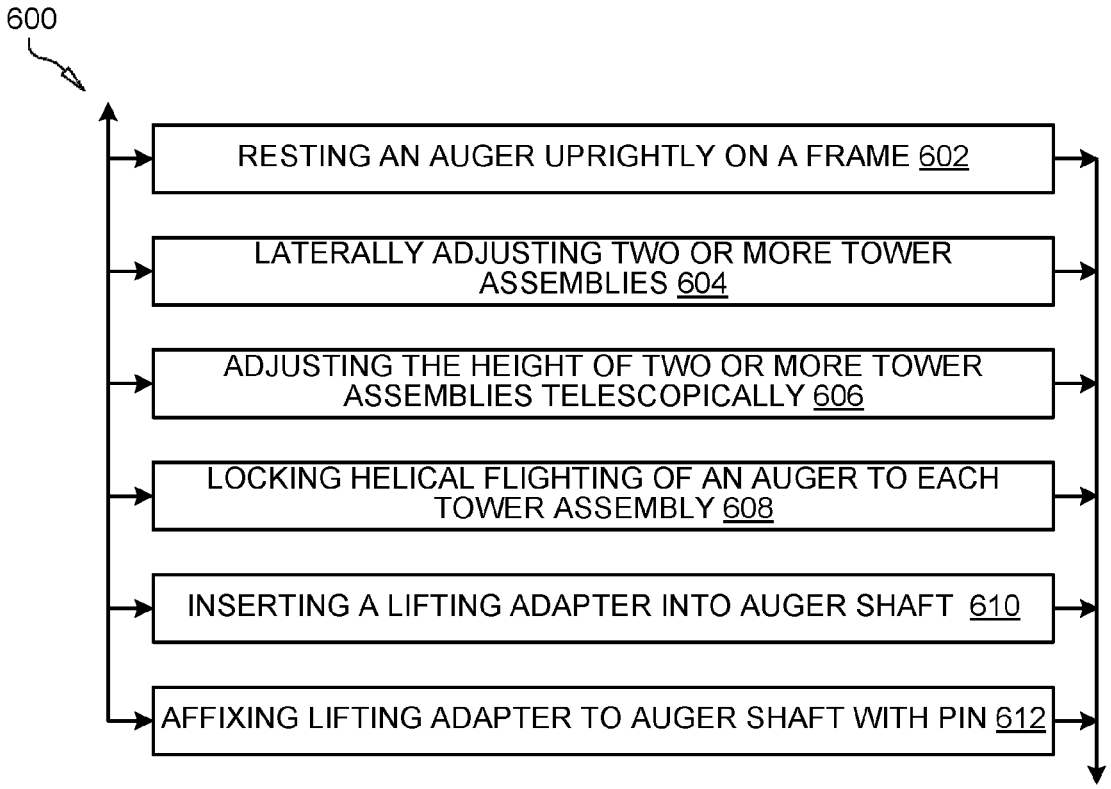
FIG. 6 is a flow chart illustrating the steps of a method of storing a foundation auger on a rack in accordance with the present invention.

FIG. 6 is a flow chart illustrating the steps of a method 600 of storing a foundation auger on a rack in accordance with the present invention.

The method 600 begins 602 with resting a auger 202 uprightly on a metallic frame such that the tip of the auger 202 is resting within a recess defined by the frame, which recess prevents lateral movement of the tip of the auger 202.

Adjusting 604 two or more tower assemblies 112 laterally on a track frame 102 such that the tower assemblies 112 abut, or nearly abut, helical flighting surrounding the auger 202. The tower assemblies 112 are then secured in place to a track frame 102.

Adjusting 606 the height of two or more tower assemblies telescopically such that a locking mechanism on the tower assembly 112 is roughly even on a z axis with adjacent helical flighting on an auger 202.

Next the method 600 progresses as the flighting on the auger 202 is locked to, secured by, or affixed to the tower assembly 112 using means known to those skill in the art.

Inserting a lifting adapter 610 into the auger shaft 610 and securing 612 the lifting adapter to the auger shaft using a pin which traverses the lifting assembly and auger shaft.

Another step may include hoisting or lifting the rack and auger 202 from a ground surface using a crane, for lift, and the like.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A rack for vertically securing a foundation auger, the rack comprising:

a frame comprising:

one or more track frames between 0.1 meters and 10 meters in length, the track frames comprising elongated structural components, each track frame defining a track through which an adjustable tower assembly travels;

wherein each track frame is oriented to converge generally diagonally across an x axis and across a y axis toward a common point of the rack;

one or more upwardly rising adjustable tower assemblies, each assembly slidably affixed to one of the one or more track frames, each adjustable tower assembly comprising:

an inner tube;

an outer tube, wherein the inner tube slides within the outer tube generally along a z axis telescopically such that a height of the tower assembly is adjustable;

a fighting rest affixed to the tower assembly for supporting a lower surface of helical fighting on the auger;

a locking mechanism for securing the helical flighting of the auger.

2. The rack of claim 1, wherein the common center point of the rack is defined by a recess separating the track frames, the recess for securing a tip of an auger from lateral movement.

3. The rack of claim 1, further comprising one or more fork pockets.

4. The rack of claim 1, further comprising one or more feet for engaging a ground surface.

5. The rack of claim 1, further comprising a sub frame affixed to the track frames.

6. The rack of claim 1, further comprising a plurality of tie down points.

7. The rack of claim 1, wherein each tower assembly comprises a baseplate slidably affixed to one of the one or more track frames such that the tower assemblies may be adjusted inward or outward to accommodate augers of different diameters.

8. The rack of claim 1, wherein each tower assembly further comprises a cantilevered locking lever hingedly affixed to the tower assembly such that the locking lever secures a top surface of helical flighting of the auger.

9. The rack of claim 1, wherein the fighting rest is hingedly affixed to the tower assembly such that the fighting rest may be tilted to correlate to an incline of helical fighting of the auger.

10. The rack of claim 1, further comprising a detachable lifting adapter, the detachable lifting adapter for facilitating craning of the rack and auger, the lifting adapter comprising:

an inner sleeve for insertable engagement of an auger shaft, the inner sleeve defining an aperture for receiving a pin traversing the inner sleeve and a corresponding aperture in the auger shaft, the pin interlocking the lifting adapter and the auger shaft; and a lifting eye affixed to the inner sleeve for hoisting the auger and rack overhead.

11. The rack of claim 1, further comprising one or more crossmembers for increased stability of the rack.

12. The rack of claim 1, wherein the track frames are oriented in one of x-shaped fashion and y-shaped fashion.

13. A rack for vertically securing a foundation auger, the rack comprising:

a frame comprising:

two or more track frames between 0.1 meters and 10 meters in length, the track frames comprising elongated structural components;

wherein each track frame is oriented to converge diagonally across an x axis and across a y axis toward a common center point of the rack;

two or more upwardly rising adjustable tower assemblies, each assembly slidably affixed to one of the two or more track frames, each adjustable tower assembly comprising:

an inner tube;

an outer tube, wherein the inner tube slides within the outer tube along a z axis telescopically such that a height of the tower assembly is adjustable;

a fighting rest affixed to one of the inner tube and the outer tube, the fighting rest for supporting a lower surface of helical fighting on the auger;

a locking mechanism for locking the helical fighting of the auger in place;

wherein each adjustable tower assembly slides along a track frame.

14. The rack of claim 13, wherein each track frame defines or more apertures for adjusting lateral positioning of the tower assemblies on the rack, wherein each tower assembly is affixed to one of the two or more track frames via an aperture.

* * * * *